US005203471A

United States Patent [19]

Widman

[11] Patent Number: 5,203,471

[45] Date of Patent: Apr. 20, 1993

[54] DETACHABLE HANDLE FOR CONTAINERS

[76] Inventor: Bruno Widman, 534 E. Lincoln Hwy., Dekalb, Ill. 60115

[21] Appl. No.: 956,965

[22] Filed: Oct. 6, 1992

[51] Int. Cl.[5] ..... B65D 23/10

[52] U.S. Cl. ..... 220/755; 220/759; 220/756; 220/769

[58] Field of Search ..... 220/759, 750, 755, 756, 220/768, 769

[56] References Cited

U.S. PATENT DOCUMENTS

| | | | |
|---|---|---|---|
| 2,788,153 | 4/1957 | Broadbelt | 220/759 |
| 2,791,350 | 5/1957 | Mennen | 220/759 |
| 3,809,285 | 5/1974 | Unger et al. | 220/759 |
| 4,433,864 | 2/1984 | Byrd | 220/759 |
| 4,702,395 | 10/1987 | Nitsch | 220/759 |
| 4,896,913 | 1/1990 | Kennedy | 220/759 |
| 4,993,767 | 2/1991 | Song | 220/759 |

*Primary Examiner*—Joseph Man-Fu Moy
*Attorney, Agent, or Firm*—Augustus G. Douvas

[57] ABSTRACT

A detachable handle adapted to engage a container, such as a paint can, formed with a continuous sidewall which terminates in a set of top and bottom peripheral edges separated one from the other by the sidewall. The handle comprises a generally C-shaped resilient body adapted for manual holding and defining an interior generally concave surface, a pair of edge engaging fingers fixed to the interior surface of the C-shaped body with each finger separated from the other so that both container edges can be engaged by the two fingers, and an elongated camming lever having a first end pivotally attached to the interior surface of the C-shaped body, and with an opposite end loosely positioned adjacent a different interior surface of the C-shaped body. The application of a manual gripping force between the camming lever and the curved body separates the edge engaging fingers one from the other by increasing their separation bite to release a container or alternatively to engage a container.

The handle includes a support platform fixed to the C-shaped body beyond the top edge engaging finger to project into an attached open container. The support platform may carry a tool which can be used as a paint scraper or as a paint brush cleaning tool. Alternatively, the support platform can be used to support a paint brush so that any paint dripping from the brush falls into an open container.

9 Claims, 2 Drawing Sheets

DETACHABLE HANDLE FOR CONTAINERS

BACKGROUND OF THE INVENTION

This invention relates to detachable handles for containers, and in particular to an improved handle adapted for use with containers housing paint which is to be brush applied.

The prior art includes a substantial number of handle designs which may be applied to containers. United States patents of general interest include the following:

U.S Pat. No. 2,689,760 issued Sep. 21, 1954 to J. A. Vanous,

U.S. Pat. No. 2,742,315 issued Apr. 17, 1950 to R. C. Dreier,

U.S. Pat. No. 2,905,500 issued Sep. 22, 1959 to T. S. Thombs,

U.S. Pat. No. 3,261,633 issued Jul. 19, 1966 to D. Sakuta,

U.S. Pat. No. 3,305,261 issued Feb. 21, 1967 to R. L. Swanke,

The prior art does not disclose a detachable handle which may be easily applied to a paint container and removed by single-handed manipulation leaving the other free for other work, and with the handle also performing several other useful tasks such as a storage support for a dripping paint brush, a tool for removing excess paint from a paint brush, and a paint scraper.

SUMMARY OF THE INVENTION

Accordingly, a principal object of this invention is to provide an improved detachable handle particularly adapted for application to containers and which is easily useable by single-handed manipulation.

Another object is to provide an improved detachable handle particularly adapted for application to containers for paint and which will serve several additional uses related to painting, namely, brush storage and cleaning, and paint scraping.

A preferred embodiment of the detachable handle of this invention is formed from a single unitary resilient plastic element which is adapted for clamping attachment to the top and bottom edges or rims of a container. This plastic element includes a C-shaped body containing a pair of spaced clamping fingers which engage the container edges or rims. A camming lever is pivotally attached to an inside concave surface of the C-shaped body. The resilient body is flexed in response to a manual gripping force applied to both the camming lever and the handle body. This force causes the spaced fingers to separate enabling the handle to be either attached or detached from a container. When the manual force is removed, the resilient body returns to its unstressed state which will cause the handle to clamp any container to which it may be applied.

The handle also includes a flared support platform which projects from the body of the handle into the cavity of any container to which the handle is applied. This platform can serve as a storage support for a paint brush and with any paint dripping from the bristles of the brush falling into the container.

The platform has a straight projecting edge which can carry an optional blade. The handle and blade combination can be used as a manually operated paint scraper, or alternatively, either the blade or the straight edge of the platform can be used as a brush cleaner.

DESCRIPTION OF THE DRAWINGS

In order that all of the structural features of this invention may be understood, reference is made to the accompanying drawings in which.

DETAILED DESCRIPTION OF THE PREFERRED EMBODIMENT

Figure 1:
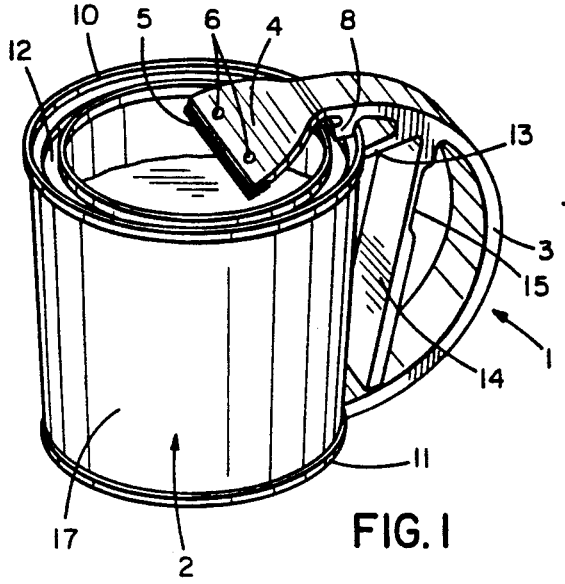
FIG. 1 is a perspective view which shows the application of a preferred embodiment of the detachable handle of this invention to an open paint can.

Referring to the drawings, detachable handle 1 of this invention is preferably formed as a single unitary piece from a resilient plastic, such as polypropylene, because many of the elements forming the handle are required to flex to effect both attachment and detachment of the handle t container 2.

Figure 8:
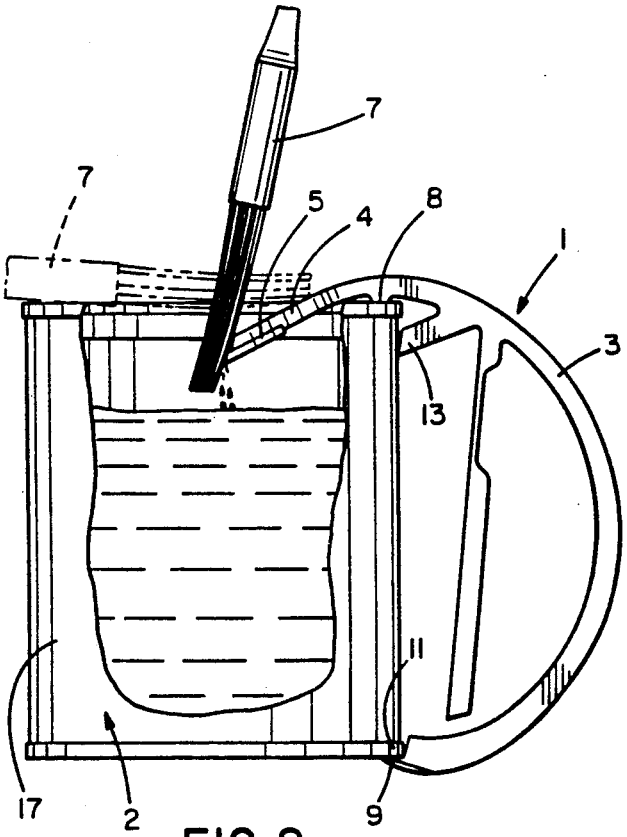
FIG. 8 is a side elevation view which shows a support platform formed as a part of the detachable handle being used to clean a paint brush, or alternatively, being used to support a paint brush (shown in the phantom lines) so that the brush bristles will drip any retained paint into the open container.
Figure 9:
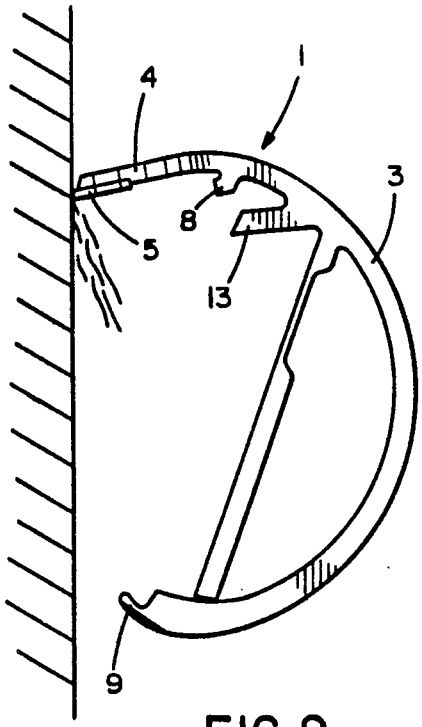
FIG. 9 is a side elevation view which shows the detachable handle in use as a scraper.

Handle 1 has a generally C-shaped body 3 of uniform width and thickness. A flared support platform 4 projects from the upper end of body 3. Platform 4 projects into container 2 (FIGS. 1, 6, 7 and 8) when handle 1 is attached to open container 2. An optional utility tool, such as metal scraper blade 5, may be fixed by rivets 6 (FIGS. 2, 3 and 4) to the lower side of platform 4 so that blade 5 can be used either as a scraper (FIG. 9), or alternatively to drain the bristles of a paint-containing brush 7 (FIG. 8) with the paint dripping into container 2.

In the event blade 5 is omitted from handle 1, the beveled straight edge 6 of platform 4 can also adequately drain paint brush 7 of any paint.

Platform 4 can be used as a support for paint brush 7 when the brush is not in use. (See brush 7 shown in phantom broken lines in FIG. 8). Any paint dripping from the bristles of brush 7 will fall into container 2.

Figure 6:
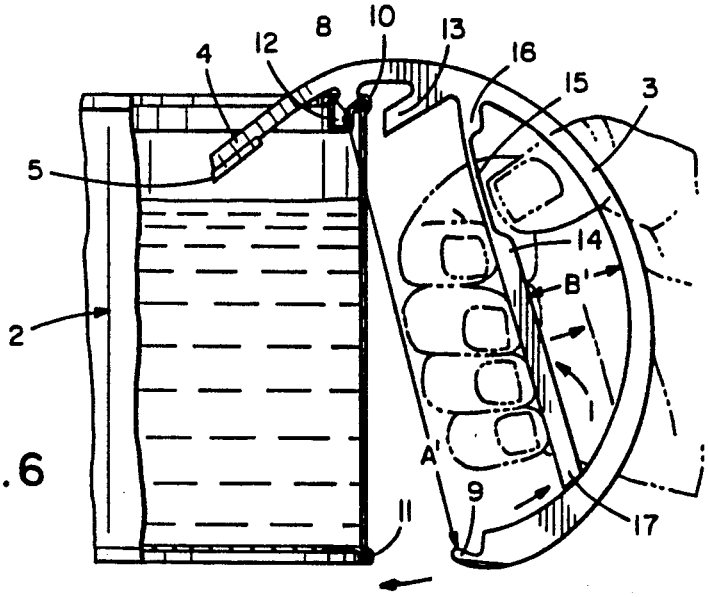
FIG. 6 is a side elevation view which shows the camming lever deforming the resilient body of the handle prior to the application of the handle to an open container containing paint.
Figure 7:
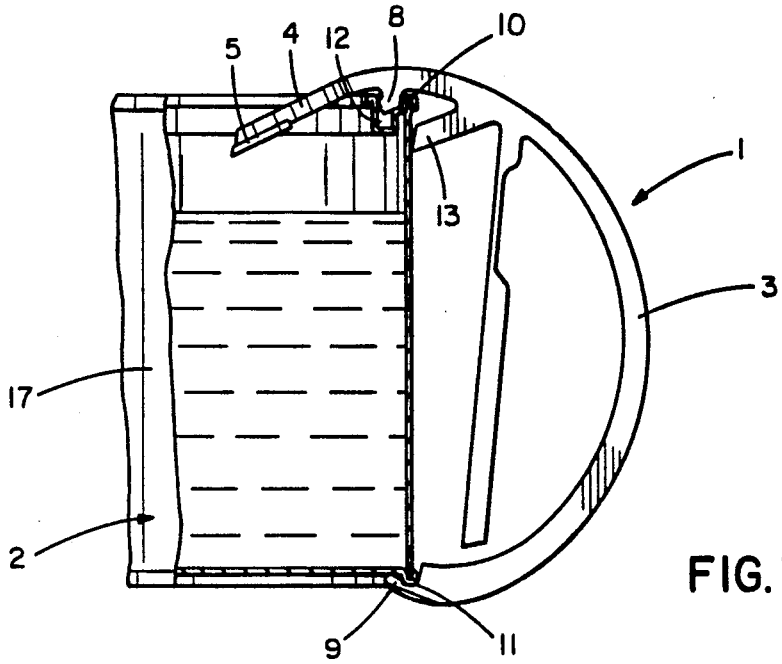
FIG. 7 is a side elevation view related to FIG. 6 which shows the detachable handle attached to the container of FIG. 6.

The interior concave surface of C-shaped body 2 is formed with a pair of projecting, edge-engaging fingers 8 and 9. These fingers are clamping fingers so located on body 3 to define a separation bite which Will clamp tightly on peripheral container edges or rims 10 and 11, respectively. Top edge 10, in the case of a paint container, includes the conventional annular lid-receiving channel 12 (FIGS. 1, 6 and 7). In the case of a container which is formed with a channel, such as channel 12, top edge engaging finger is preferably seated within channel 12 as is shown in FIGS. 1, 6 and 7.

Guide finger 13 projects from the inner concave surface of handle 3 closely adjacent to top-edge engaging finger 8. Fingers 8 and 13 jointly define mouth 14 which receives top edge 10 when handle 1 is attached to container 2. Guide finger 13 serves both to align and to lo? k handle 1 on container 2.

Figure 2:
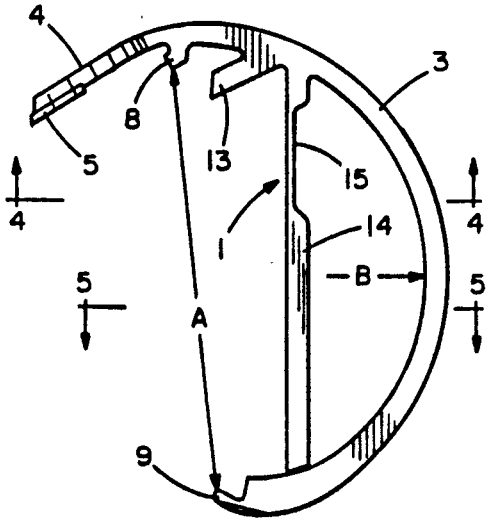
FIG. 2 is a side elevation view of the detachable handle of FIG. 1.
Figure 3:
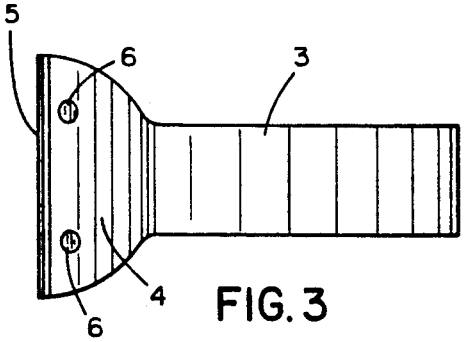
FIG. 3 is a top view of the detachable handle of the prior Figures.
Figure 4:
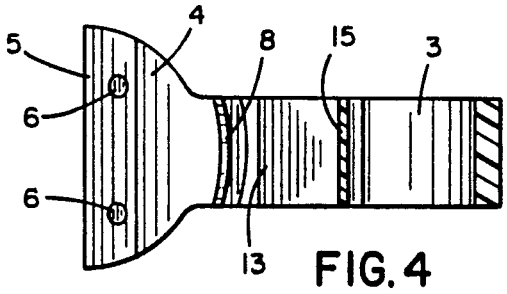
FIG. 4 is a section view taken along line 4—4 of FIG. 2.

In order both to attach and to detach handle 1 to and from container 2, it is necessary to expand the clamping bite distance A (FIG. 2) between fingers 8 and 9 from that normally provided by resilient body 3 when the body is in the unstressed condition of FIG. 2. The expansion of this bite distance is effected by the novel function and structure of pivoting camming lever 14 (FIGS. 2 and 4).

Camming lever 14 is an elongated element of generally uniform width with a reduced thickness section 15. The upper end 16 of lever 14 is flexibly attached to the inner Concave surface of body 3 adjacent to guide finger 13. The lower end 17 of lever 14 hangs loosely adjacent the adjacent inner surface of body 3. Reduced thickness section 15 is located close to the line of attachment of lever 14 to body 3 in order to facilitate the pivotal Camming movement of lever 14 against the lower inner surface of body 3. In particular, when a manual gripping force is applied between body 3 and lever 14 (FIG. 4) tending to reduce the separation distance B (FIG. 2) between these two elements to that of B' of FIG. 4, the lower end 17 of lever 14 is moved upwardly along the lower inner surface of body 3 (FIG. 4) forcing the lower end of body 3 to enlarge the unstressed bite distance A of FIG. 2 to that of the stressed bite distance A' of FIG. 4. The enlargement of the bite distance in response to manual gripping of handle 1, enables the handle to be easily applied to container 2 and also removed through the use of only a single hand. This feature enables a painter to use his other hand for alternative work. When the manual gripping force is released, the resiliency of body 2 reduces the bite distance to the unstressed distance A (FIG. 2) thereby effecting a reliable clamp on container 2.

Figure 5:
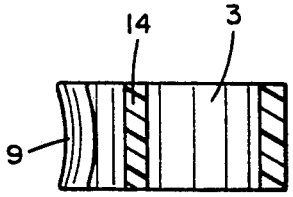
FIG. 5 is a section view taken along line 5—5 of FIG. 2.

It should be noted that fingers 8, 9 and 14 have curved edges (FIG. 4 and 5) so as to mate closely with the circular edges 8 and 11 and the cylindrical sidewall 18 joining these edges.

It should be understood that the structure of the preferred embodiment just described can be modified without departing from the claimed scope of the invention.

What is claimed is:

1. A detachable handle adapted to engage a container formed with a continuous sidewall which terminates in a pair of peripheral edges separated one from the other by the sidewall, comprising a generally curved bendable body adapted for manual holding and with the curved body defining an interior generally concave surface, a pair of edge engaging means fixed to the interior surface of the curved body with each such means separated from the other, and an elongated camming lever having a first end pivotally attached to the interior surface of the curved body and having an opposite end loosely positioned adjacent a different interior surface of the curved body whereby the application of a manual gripping force between the camming lever and the curving body separates the edge engaging fingers one from the other to release thereby any container to which the detachable handle is attached.

2. A detachable handle adapted to engage a container formed with a continuous sidewall which terminates in a pair of peripheral edges separated one from the other by the sidewall, comprising a generally curved bendable body adapted for manual holding and with the curved body defining an interior generally concave surface, a pair of edge engaging means fixed to the interior surface of the curved body with each such means separated from the other, and an elongated camming lever having a first end pivotally attached to the interior surface of the curved body generally adjacent one of the edge engaging means and having an opposite end loosely positioned adjacent a different interior surface of the curved body generally adjacent the other of the edge engaging means whereby the application of a manual gripping force between the camming lever and the curved body separates the other edge engaging means from an engaged edge thereby detaching the handle from any container to which the detachable handle is attached.

3. A detachable handle adapted to engage a container formed with a continuous sidewall which terminates in a set of top and bottom peripheral edges separated one from the other by the sidewall, comprising a generally C-shaped resilient body adapted for manual holding and defining an interior generally concave surface, a set of top and bottom edge engaging fingers fixed to the interior surface of the C-shaped body with each finger separated from the other so that both container edges can be engaged by the two fingers, and an elongated camming lever having a first end pivotally attached to the interior surface of the curved body adjacent the top edge and with an opposite end loosely positioned adjacent a different interior surface of the C-shaped body adjacent the bottom edge whereby the application of a manual gripping force between the camming lever and the curved body separates the bottom engaging finger from an engaged bottom edge thereby detaching the handle from any container to which the detachable handle is attached.

4. The detachable handle of claim 3 in which the camming lever is formed with a reduced section adjacent its first end to facilitate the pivotal movement of the lever in response to a manual gripping force so as to flex the handle body thereby disengaging or engaging the bottom finger from or to a bottom edge.

5. The detachable handle of claim 3, comprising a guide finger fixed to the interior surface of the C-shaped body adjacent the top finger to contact and rest against the container sidewall with the top finger and the guide finger defining a top edge engaging mouth for receiving and holding the top edge of any attached container.

6. The detachable handle of claim 3 comprising a support platform fixed to the body beyond the top edge engaging finger to project into an attached container having an open top.

7. The detachable handle of claim 6 comprising a utility tool fixed to the support platform.

8. The detachable handle of claim 7 in which the utility tool is a paint scraping blade.

9. The detachable handle of claim 6 in which the support platform is formed with a generally straight projecting edge which may be used for cleaning a paint brush with any paint removed from the brush dripping into a container having an open top.

* * * * *